United States Patent [19]

Yamanishi et al.

[11] 4,366,268

[45] Dec. 28, 1982

[54] MOLDING STAND

[75] Inventors: Akio Yamanishi; Kanichi Sato; Takashi Higashino, all of Hirakata, Japan

[73] Assignee: Kabushiki Kaisha Komatsu Seisakusho, Tokyo, Japan

[21] Appl. No.: 276,700

[22] Filed: Jun. 23, 1981

[30] Foreign Application Priority Data

Dec. 21, 1978 [JP] Japan ..... 53-156924

[51] Int. Cl.[3] ..... C08L 61/04

[52] U.S. Cl. ..... 523/144; 523/145; 523/205; 523/209; 524/502; 524/503; 524/509

[58] Field of Search ..... 260/38, 42.14; 264/26; 164/21, 48, 527; 523/139, 143, 144, 145; 524/503, 509

[56] References Cited

U.S. PATENT DOCUMENTS 2,772,457 12/1956 Webbere ..... 164/21

3,692,085 9/1972 Brown et al. ..... 164/48

FOREIGN PATENT DOCUMENTS 1109322 6/1961 Fed. Rep. of Germany ..... 164/21

*Primary Examiner*—Lewis T. Jacobs

*Attorney, Agent, or Firm*—Armstrong, Nikaido, Marmelstein & Kubovcik

[57] ABSTRACT

A molding sand for use in a molding process employing a microwave radiation for curing the molding sand. The molding sand comprises a new sand, a carbonized resin coated sand and a thermosetting or thermoplastic resin. The carbonized resin coated sand is preferably subjected to a scrubbing treatment prior to the admixture thereof with the new sand.

5 Claims, No Drawings

MOLDING STAND

BACKGROUND OF THE INVENTION

This invention relates to a molding sand adapted to be cured by a microwave radiation.

One of the conventional methods for making molds comprises forming a metal pattern, heating the metal pattern to an elevated temperature, applying a molding material including a thermosetting resin therein to the heated metal pattern thereby hardening or curing the molding material by heat conduction from the heated metal pattern and finally separating the metal pattern from the cured molding material. In this method, however, since the pattern is made of metal, the cost for making the pattern will necessarily become expensive and it is difficult to produce a complicated shape of pattern. Besides, the molding material is cured by the heat conduction from the metal pattern with producing a great deal of energy loss and therefore a poor energy efficiency is obtained.

Another conventional method for making molds includes forming a metal pattern, heating the metal pattern to an elevated temperature about 250° C., coating a powdered facing agent on the heated metal pattern by spraying, applying a molding material including a thermosetting resin therein to the facing agent coated and still heated metal pattern thereby curing the molding material by heat conduction from the heated metal pattern and finally separating the metal pattern from the cured molding material.

Casting surface of cast product produced by using this mold is very fine and it is possible to obtain roughness of 200 RMS for aluminum and 300 RMS for FC material of Japanese Industrial Standard. This method too, however, has same problems associated with the metal pattern described above.

In order to solve problems associated with the metal pattern, two of the applicants of the present invention have developed a new method for making molds and filed a U.S. patent application Ser. No. 237,767 on Feb. 24, 1981. The application has been assigned to the same assignee of the present application. In that application there is proposed a method for making a mold, comprising the steps of: forming a pattern with a material which allows microwave to pass therethrough, covering the pattern with a molding material including a thermosetting resin and a dielectric material to the microwave, exposing the molding material covered pattern to a microwave radiation for a time sufficient to cure the molding material by heat generated therein, and separating the pattern from the cured molding material.

According to the above method, since the microwave radiation is employed for heating and curing the molding material, heat loss can be minimized and energy efficiency is significantly improved compared with a typical conventional method employing the heat conduction from a heated metal pattern for heating and curing the molding material. Molding material or sand disclosed in that application is a mixture of silica, phenol resin and graphite powders. When this molding sand is used in the microwave curing molding process, time required to cure the molding sand is extended to about 6 minutes and a mold thus produced has a relatively low transverse strength (about 25 kg/cm$^2$).

SUMMARY OF THE INVENTION

It is therefore an object of the present invention to provide a molding sand adapted to be cured by a microwave radiation wherein time required to cure the molding sand is shortened.

Another object of the present invention is to provide a molding sand for use in a process employing a microwave radiation for curing the molding sand wherein a mold thus produced has a high transverse strength.

In accordance with an aspect of the present invention, there is provided a molding sand for use in a molding process employing a microwave radiation for curing the molding sand, wherein the molding sand comprises a thermosetting or thermoplastic resin, a new sand and a carbonized resin coated sand.

Thermosetting resin employed herein is phenol resin or furan resin and thermoplastic resin is either polyvinyl alcohol or polyacrylic ester.

New sand comprising mainly silica sand is included about 25 to 75 parts, carbonized resin coated sand about 75 to 25 parts, and resin about 2 to 5 parts, respectively.

More preferably the molding sand includes new sand about 50 parts, carbonized resin coated sand about 50 parts and resin about 3.5 parts. One of the important features of the present invention is to employ a carbonized resin coated sand as a dielectric material to the microwave. By employing this important feature, curing time of the molding sand becomes significantly shortened and transverse strength of the mold improves dramatically as compared with a prior art technique.

Methods for producing dielectric material to the microwave will be described hereinbelow.

In the first method, an organic resin is admixed with sand to produce a resin coated sand. The resin coated sand thus produced is heated to an elevated temperature of about 350° to about 450° C. depending upon the kind of resin used therein, thereby carbonizing the resin coating on the sand. The sand having carbonized resin coating is then subjected to a scrubbing treatment to obtain a carbonized resin coated sand having a uniform carbonized resin coated layer thereon. This carbonized resin coated sand is used as a dielectric material.

In the second method, a carbonized resin coated sand is produced from a mold composed of shell mold sand, hot box sand or organic self-curing sand when such a mold is used for casting and is shaken-out. The produced carbonized resin coated sand is then subjected to the scrubbing treatment to obtain a carbonized resin coated sand having a uniform carbonized resin coating layer thereon. This carbonized resin coated sand is used as a dielectric material.

By using molding sand admixed with carbonized resin coated sand produced by either the first method or the second method as dielectric material, a mold having high transverse strength can be produced in a short time.

EXAMPLE 1

After casting molten metal in a mold composed of shell mold sand having 3.5 wt% phenol resin admixed thereto, the mold was shaken-out producing a small amount of carbonized resin coated sand. By repeating casting and shaking-out of the mold, a required amount of carbonized resin coated sand was produced. After subjecting the carbonized resin coated sand to a scrubbing treatment, an equal amount of new sand was admixed with this carbonized resin coated sand. Then 3.5 wt% phenol resin was added to the mixture to produce resin coated molding sand. Then the resin coated molding sand including carbonized resin coated sand therein was poured into a pattern and cured by a microwave radiation. It took only 3 minutes for curing the resin coated molding sand in a microwave radiation curing process and mold thus produced had transverse strength of 60 kg/cm$^2$. This is a significant improvement over a prior art molding sand composed of a mixture of sand, phenol resin and 2% graphite powders wherein curing time thereof is 6 minutes and transverse strength of the mold is 25 kg/cm$^2$.

EXAMPLE 2

3% phenol resin was added to new sand to produce resin coated sand, which was then heated to an elevated temperature of 400° C. for a sufficient time to produce carbonized resin coated sand. After subjecting the carbonized resin coated sand to the scrubbing treatment, 25 parts of scrubbing device treated carbonized resin coated sand was admixed with 75 parts of new sand. Then 3.5% phenol resin was added to the mixture to produce resin coated molding sand including carbonized resin coated sand therein. This molding sand was cured for 4 minutes by the microwave radiation and mold thus produced had transverse strength of 55 kg/cm$^2$.

EXAMPLE 3

Scrubbing device treated carbonized resin coated sand was prepared like example 1. Carbonized resin coated sand 50 parts were admixed with the new sand 50 parts. Water soluble phenol resin 3.5 parts were added to the mixture to produce resin coated molding sand including carbonized resin coated sand therein. The water soluble phenol resin used herein had resin amount of 65% and viscosity of 75 cp. This molding sand was cured for 2 minutes by the microwave radiation and mold thus produced had transverse strength of 45 kg/cm$^2$.

EXAMPLE 4

Scrubbing device treated carbonized resin coated sand was prepared like example 1. Carbonized resin coated sand 50 parts were admixed with new sand 50 parts. Furan resin 3.5 parts and furan resin curing agent 0.35 parts were added to the admixture to produce resin coated molding sand containing carbonized resin coated sand therein. This molding sand was cured for one minute by the microwave radiation and mold thus produced had transverse strength of 41 kg/cm$^2$.

As is apparent from this example when furan resin is used, a quick curing time can be obtained. However, molding sand containing furan resin is only capable of being used for molding for about 2 to 3 hours after it has been admixed and coated with furan.

EXAMPLE 5

Scrubbing device treated carbonized resin coated sand was prepared like example 1. Carbonized resin coated sand 50 parts were admixed with new sand 50 parts. Polyvinyl alcohol 3 parts and water one part were added to the admixture to produce resin coated molding sand containing carbonized resin coated sand therein. This molding sand was cured for 2 minutes by the microwave radiation and mold thus produced had transverse strength of 24 kg/cm$^2$. Polyvinyl alcohol used herein had degree of sponification of 98% and molecular weight of 1700 and was applied in the form of 20% aqueous solution.

EXAMPLE 6

Scrubbing device treated carbonized resin coated sand was prepared like example 1. Carbonized resin coated sand 50 parts were admixed with new sand 50 parts and then polyacrylic ester resin 2 parts and water 0.5 part were added to the admixture to produce resin coated molding sand containing carbonized resin coated sand therein. This molding sand was cured for 1.5 minutes by the microwave radiation and mold thus produced had transverse strength of 30 kg/cm$^2$. Polyacrylic ester resin used herein had 30% resin content.

To compare the results of the above examples with prior art molding sands, two kinds of prior art molding sands were prepared and tested.

In the first comparative example, molding sand including new sand 100 parts and phenol resin 3.5 parts was prepared. It took 18 minutes to cure the molding sand and mold thus produced had transverse strength of 38 kg/cm$^2$. In the second comparative example, molding sand including new sand 100 parts, graphite 2 parts and phenol resin 3.5 parts was prepared. It took 6 minutes to cure the molding sand and mold thus produced had transverse strength of 25 kg/cm$^2$.

It is apparent from the above results that molding sands of the present invention need less curing time and molds produced therefrom have relatively high transverse strength.

Advantages of the present invention using carbonized sand as dielectric material would be summarized as follows:

(1) Molding sand is economically produced since no graphite is added thereto.

(2) Because strength deterioration of the mold is significantly low as compared with prior art mold having dielectric material added thereto, resin to be added can be kept low.

(3) Because resin coating is uniformly carbonized, it is possible to heat the mold uniformly.

(3) Curing time of the molding sand can be significantly shortened as compared with prior art mold sand having graphite added thereto.

What is claimed is:

1. A molding sand for use in a molding process employing a microwave radiation for curing the molding sand, said molding sand comprising a new sand about 25 to about 75 parts by weight, a carbonized resin coated sand about 75 to about 25 parts by weight and a thermosetting or thermoplastic resin about 2 to 5 parts by weight.

2. A molding sand according to claim 1 wherein said carbonized resin coated sand is subjected to a scrubbing treatment prior to an admixture thereof with said new sand.

3. A molding sand according to claim 2 wherein said thermosetting resin is selected from the group consisting essentially of phenol resin and furan resin.

4. A molding sand according to claim 2 wherein said thermoplastic resin is selected from the group consisting essentially of polyvinyl alcohol and polyacrylic ester resin.

5. A molding sand according to claim 1 or 2 wherein said molding sand comprises the new sand about 50 parts by weight, the carbonized resin coated sand about 50 parts by weight and the thermosetting resin about 3.5 parts by weight.

* * * * *

UNITED STATES PATENT AND TRADEMARK OFFICE

CERTIFICATE OF CORRECTION

PATENT NO. : 4,366,268

DATED : December 28, 1982

INVENTOR(S) : Yamanishi et al.

It is certified that error appears in the above-identified patent and that said Letters Patent are hereby corrected as shown below:

In the Title, delete "STAND" and substitute --SAND--.

Column 1, line 1, delete "STAND" and substitute --SAND--.

Signed and Sealed this

*Twelfth* Day of *June 1984*

[SEAL]

*Attest:*

GERALD J. MOSSINGHOFF

*Attesting Officer*

*Commissioner of Patents and Trademarks*